US006414443B2

(12) United States Patent
Tsuruoka et al.

(10) Patent No.: US 6,414,443 B2
(45) Date of Patent: Jul. 2, 2002

(54) ORGANIC ELECTROLUMINESCENCE DEVICE AND METHOD FOR DRIVING SAME

(75) Inventors: Yoshihisa Tsuruoka; Yoshihisa Marushima, both of Mobara (JP)

(73) Assignee: Futaba Denshi Kogyo Kabushiki Kaisha, Chiba (JP)

( * ) Notice: Subject to any disclaimer, the term of this patent is extended or adjusted under 35 U.S.C. 154(b) by 0 days.

(21) Appl. No.: 09/777,580

(22) Filed: Feb. 6, 2001

(30) Foreign Application Priority Data

Feb. 7, 2000 (JP) ..... 2000-029583

(51) Int. Cl.[7] ..... G09G 3/10

(52) U.S. Cl. ..... 315/169.3; 315/169.1; 315/168; 345/45; 345/48; 345/77

(58) Field of Search ..... 315/169.3, 169.1, 315/168, 169.2, 167; 345/44, 45, 48, 76, 77, 84; 313/504, 506

(56) References Cited

U.S. PATENT DOCUMENTS 5,552,678 A * 9/1996 Tang et al. ..... 257/40
5,886,474 A * 3/1999 Asai et al. ..... 315/169.1
6,222,323 B1 * 4/2001 Yamashita et al. ..... 315/169.1

* cited by examiner

*Primary Examiner*—Haissa Philogene
(74) *Attorney, Agent, or Firm*—Katten Muhin Zavis Rosenman

(57) ABSTRACT

In an organic electroluminescence (EL) device including a display section having one or more light emitting units and a monitoring section positioned outside the display section and having one or more monitoring cells, each of the light emitting units and the monitoring cells has a cathode, an anode and at least one organic EL layer positioned between the cathode and the anode. In the organic EL device, either cathodes or anodes of the light emitting units and the monitoring cells is transparent and a current passing through an anode and a cathode of a monitoring cell is monitored to control the light emitting units.

9 Claims, 6 Drawing Sheets

ORGANIC ELECTROLUMINESCENCE DEVICE AND METHOD FOR DRIVING SAME

FIELD OF THE INVENTION

The present invention relates to an organic electroluminescence (EL) device and a method for driving same.

BACKGROUND OF THE INVENTION

FIG. 6A shows a schematic diagram of a conventional organic electroluminescent (EL) device 600, which is operated under a constant current applied thereto. As shown in FIG. 6A, the organic EL device 600 includes a cathode 101, a light emitting layer 102, an organic hole carrying layer 103, a transparent anode 104 and a glass substrate 105. In the organic EL device 600, the light emitting layer 102 and the organic hole transfer layer 103 are formed between the cathode 101 and the transparent anode 104 as shown in FIG. 6A. The transparent anode 104 is disposed on the glass substrate 105 and the cathode 101 and the transparent anode 104 are connected to a power source 110.

The light emitting layer 102 may be made of an organic fluorescent film, e.g., the so-called Alq3 (tris(8-quinolinolato) aluminum); the organic hole transfer layer 103 may be made of a triphenylamine. The cathode 101 is a metallic electrode, which may be made of an alloy, e.g., Mg—Ag or Al—Li, and the transparent anode 104 may be made of an Indium Tin Oxide (ITO). There has been also known an organic EL device, wherein an organic electron transfer layer is formed between the cathode electrode 101 and the light emitting layer 102.

FIG. 6B reveals a partial cutaway view of the conventional organic EL device 600 for use in a dot-matrix type display. In this EL device, light emitting portions are defined by the cathodes 101 and the transparent anodes 104 facing each other and having the light emitting layer 102 and the organic hole transfer layer 103 therebetween. Each overlapping region of the cathodes 101 and the anodes 104 constitutes a pixel of the light emitting portions.

Such an organic EL device is a self-luminescent display device capable of being driven by a DC voltage. The organic EL device is of a thin and light flat panel display, having a large viewing angle, high brightness and a high impact resistance since the organic EL device is a solid-state device. The luminescence of the organic EL device is proportional to an integrated value of currents applied thereto. The organic EL device has high responsiveness and high luminescent efficiency. The organic EL device can achieve a luminescence level of, e.g., 1000 cd/m$^2$ when a DC voltage of 10 V is applied between an anode and a cathode thereof for low voltage driving thereof.

Since, however, the organic EL device is formed with very thin films, there may easily occur micro-shorts due to a surface roughness of the transparent electrode or inclusion of impurities. If a short occurs at a single spot in the circuit of the organic EL device, the current is concentrated thereon, thereby greatly affecting the luminescence and being unable to turn on the light emitting portions along the line where the short occurred, which results in the yield of the device being deteriorated.

In a display device such as a vacuum fluorescent display device or a liquid crystal display device, a constant voltage driver is usually employed in lieu of a constant current driver, which is costly and less available.

However, the use of less costly constant voltage driver in the organic EL device entails certain problems that the luminescence level thereof varies a lot with the temperature change thereof. Referring to data and graphs corresponding to non-compensation items in Table 1 and FIG. 3 to be described later in detail, respectively, even when the temperature of the organic EL device is increased by only about 20° C. (i.e., from 30° C. to 50° C.), the luminescence level thereof is increased about 2.1 times. Further, if a voltage applied to the organic EL device is increased, durability of the device is decreased.

The use of a constant voltage driver in an organic EL device, having luminescent elements disposed in a matrix form and employing a highly resistant transparent conductive ITO film as an anode wiring thereof, entails a luminescence gradient to occur between an upper part and a lower part of the matrix due to the voltage drop in the ITO film. Further, there occurs a great luminescence change within a operating temperature range due to intrinsic temperature dependency of the organic EL device.

For example, an organic EL device of an average luminescence level of 300 cd/m$^2$ with a duty ratio 1/240 for a dot of 0.3 mm$^2$ requires an instantaneous luminescence level of 72000 cd/m$^2$. When an Alq3 is used as a light emitting layer, a current of 2.4 mA is required to flow through a dot of 0.3 mm$^2$. When a sheet resistance of an anode ITO is 20 Ω and a length of wiring between an upper most dot and a lower most dot thereof is 72(=0.3×240) mm, a wiring resistance becomes 5 kΩ. In this case, if a current of 2.4 mA flows, a voltage drop becomes 12 V and there occurs a luminescence difference greater than a factor of 1/10 between the upper most dot and the lower most dot thereof.

SUMMARY OF THE INVENTION

It is, therefore, an object of the present invention to provide an organic electroluminescece (EL) device and a method for driving same, wherein the organic EL device is driven in a constant voltage mode by using a constant voltage driver. The organic EL device has a monitoring section outside a light emitting section, wherein a variation of an internal resistance in the monitoring section due to a temperature change is detected by using a current therethrough and is fed back to a driving voltage of a power supply.

In accordance with one aspect of the present invention, there is provided an organic electroluminescence (EL) device including:

a display section having one or more light emitting units; and a monitoring section positioned outside the display section and having one or more monitoring cells, wherein each of the light emitting units and the monitoring cells includes a cathode, an anode and at least one organic EL layer positioned between the cathode and the anode, either cathodes or anodes of the light emitting units and the monitoring cells being transparent, and wherein a current passing through an anode and a cathode of a monitoring cell is monitored to control the light emitting units.

In accordance with another aspect of the present invention, there is provided a method for driving an organic electroluminescence device having a monitoring section and a light emitting section, the method including the steps of:

flowing a constant current through the monitoring section;

monitoring a voltage due to the constant current; and applying an operation voltage to the light emitting section, the operation voltage being obtained by a feed-back of the monitored voltage.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE PREFERRED EMBODIMENTS

Figure 1A:
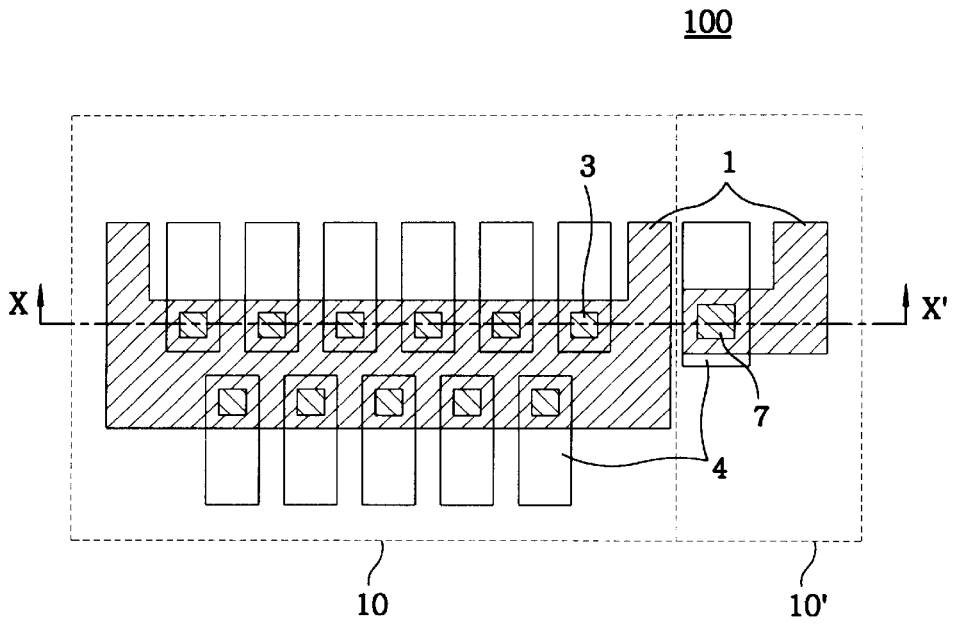
FIGS. 1A and 1B represent a schematic plan view and a schematic cross sectional view of an organic electroluminescence (EL) display apparatus in accordance with a first preferred embodiment of the present invention, respectively.
Figure 1B:
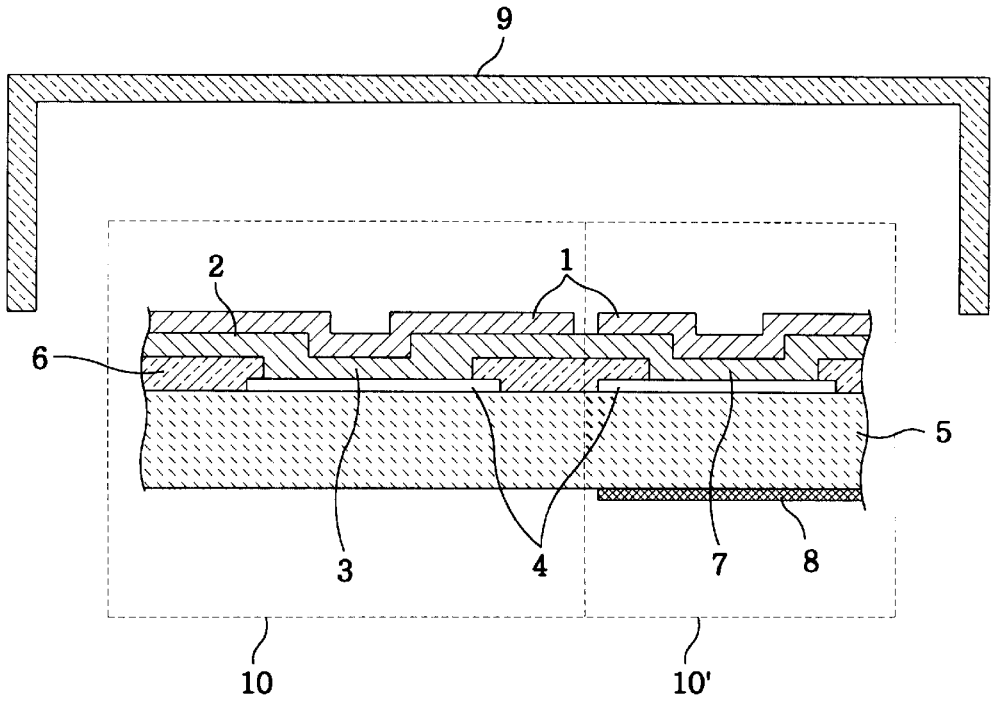

FIGS. 1A and 1B represent a schematic plan view and a schematic cross sectional view taken along a line X-X' of an organic electroluminescence (EL) display apparatus 100 in accordance with a first preferred embodiment of the present invention, respectively.

In FIGS. 1A and 1B, the organic EL display apparatus 100 includes cathodes 1 which may be made of such an alloy as Mg—Ag or Al—Li; an organic layer 2 which is of a multi-layered (two-layered or three-layered) structure having an organic hole transfer layer (not shown) and a light emitting layer (not shown) and further an organic electron transfer layer (not shown) if required; light emitting units or cells 3; transparent anodes 4 which may be made of indium tin oxide (ITO); a transparent glass substrate 5; and an insulating layer 6. The organic EL display apparatus 100 is divided into two sections, i.e., a display section 10 and a monitoring section 10' which is disposed outside the display section 10, and further includes a blocking layer 8 to block light emitted from a monitoring cell 7 of the monitoring section 10' and a sealing cap 9 for protecting the structure on the glass substrate 5.

Figure 2A:
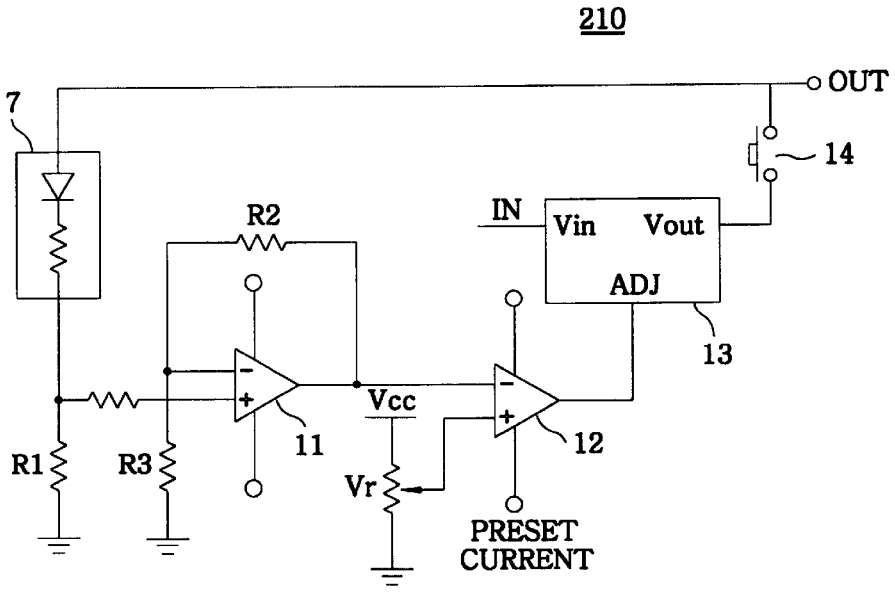
FIGS. 2A and 2B depict temperature compensation circuits in the organic EL display apparatus in accordance with the first preferred embodiment of the present invention.

FIG. 2A depicts a temperature compensation circuit (e.g., a driving voltage control circuit) 210 for statically driving, e.g., the organic EL display apparatus 100 in accordance with the present invention. In FIG. 2A, the monitoring cell 7 is represented by an equivalent circuit having a diode and a resistor. The temperature compensation circuit 210 has the monitoring cell 7, an amplifier 11, a comparator 12, a voltage regulator 13 and a switch 14 and resistors R1, R2, R3. A current flowing through the monitoring cell 7 is converted by the resistor R1 into a voltage, which in turn is amplified by the amplifier 11 with a preset gain (R3/R2).

The comparator 12 compares the output voltage from the amplifier 11 with a preset current and the output from the comparator 12 is regulated by the three terminal voltage regulator 13. The regulated voltage from the voltage regulator 13 is transmitted through the switch 14 and an output terminal OUT to a display control circuit (not shown) for controlling the display section 10. The switch 14 is controlled to be on when the organic EL device 100 is turned on.

Figure 2B:
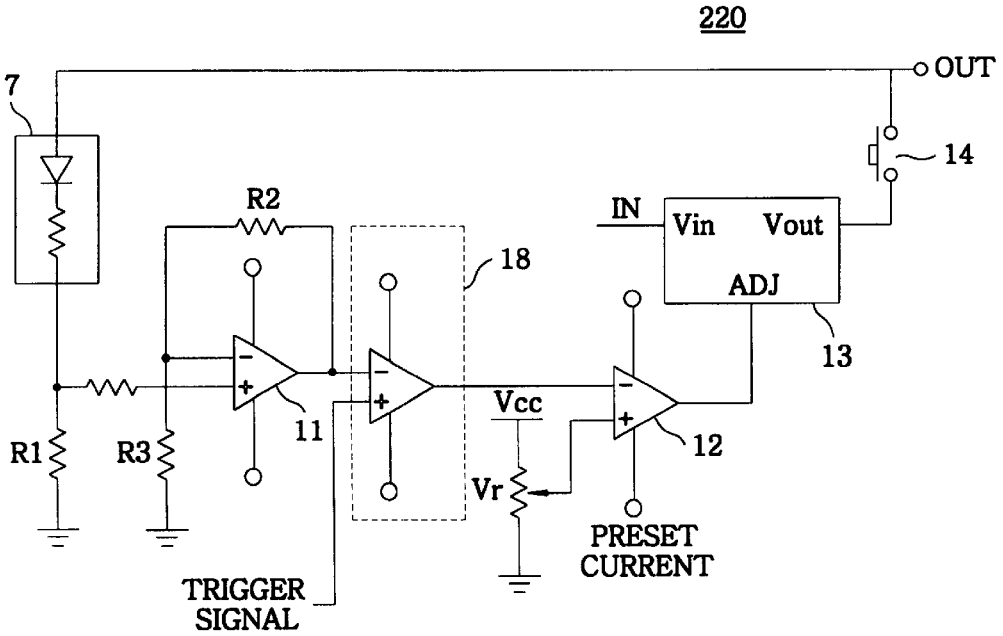

FIG. 2B illustrates a temperature compensation circuit 220 for dynamically driving, e.g., the organic EL display apparatus 100 in accordance with the present invention. In FIG. 2B, one cell outside the display section 10 which is adopted as the monitoring cell 7 and a sample and hold circuit 18 is installed next to the amplifier 11. A trigger signal for a timing of dynamic driving is received through an external trigger terminal of the sample and hold circuit 18 and then a voltage is sampled at every timing of dynamic driving of the organic EL display apparatus 100 to thereby control the driving voltage thereof. The sampling interval can be adjusted by controlling the interval of the trigger signal inputted from an external trigger (not shown).

Figure 6A:
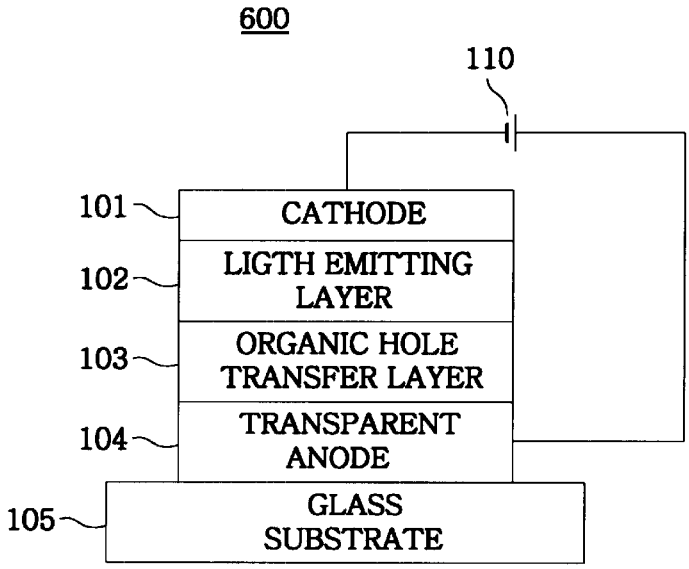
FIG. 6A (PRIOR ART)
FIG. 6A shows a schematic diagram of a conventional organic EL device, which is operated under a constant current applied thereto and FIG. 6B reveals a partial cutaway view of the conventional organic EL device for use in a dot-matrix type display.
Figure 6B:
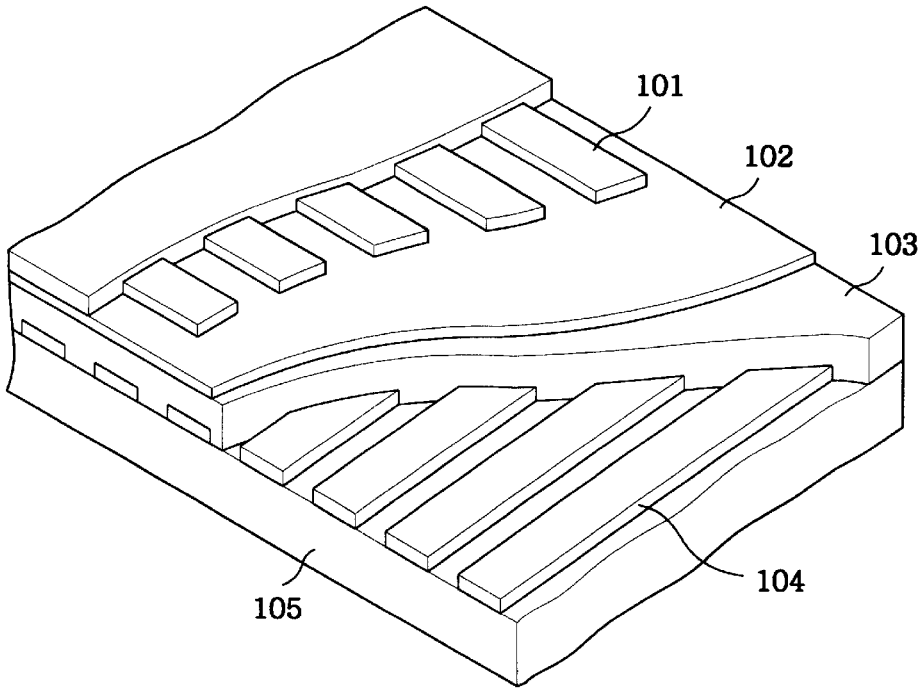
FIG. 6B (PRIOR ART)

The light emitting units 3 of the organic EL display apparatus 100 shown in FIGS. 1A and 1B emit light by applying a voltage between the cathodes 1 and the transparent anodes 4 in a similar manner as in the conventional organic EL device 600 as shown in FIG. 6A. In accordance with the present invention, a current flowing through the organic EL display apparatus 100 can be maintained at a uniform level regardless of the temperature thereof since a driving voltage is determined such that a current flowing through the monitoring cell 7 installed outside the display section 10 as shown in FIGS. 2A and 2B is equal to the preset current applied to the comparator 12.

The temperature compensation circuit 210 shown in FIG. 2A is used for statically driving a constant voltage driver. When the switch 14 of the temperature compensation circuit 210 is on, a current flowing through the monitoring cell 7 by the output of the regulator 13 flows to the ground through the electric sensing resistor R1, which is small enough not to cause the change in the luminescence of the monitoring cell 7, and a voltage corresponding to the current flowing through the monitoring cell 7 is developed in the resistor R1. This voltage is amplified with a preset gain (R3/R2) at the amplifier 11 and outputted to the comparator 12.

The preset current applied to the comparator 12 is converted into a corresponding voltage by a variable resistor. An error signal outputted in the form of a voltage from the comparator 12 is fed back to the regulator 13 as a control voltage (ADJ) for adjusting the voltage $V_{out}$ of the regulator 13. As a result, a current flowing through the monitoring cell 7, i.e., a current flowing through the display section 10 under the control of the voltage through the output terminal OUT can remain intact even when there is a temperature change in the organic EL display device 100, and therefore, the luminescence level thereof is not affected by the temperature change.

Figure 3:
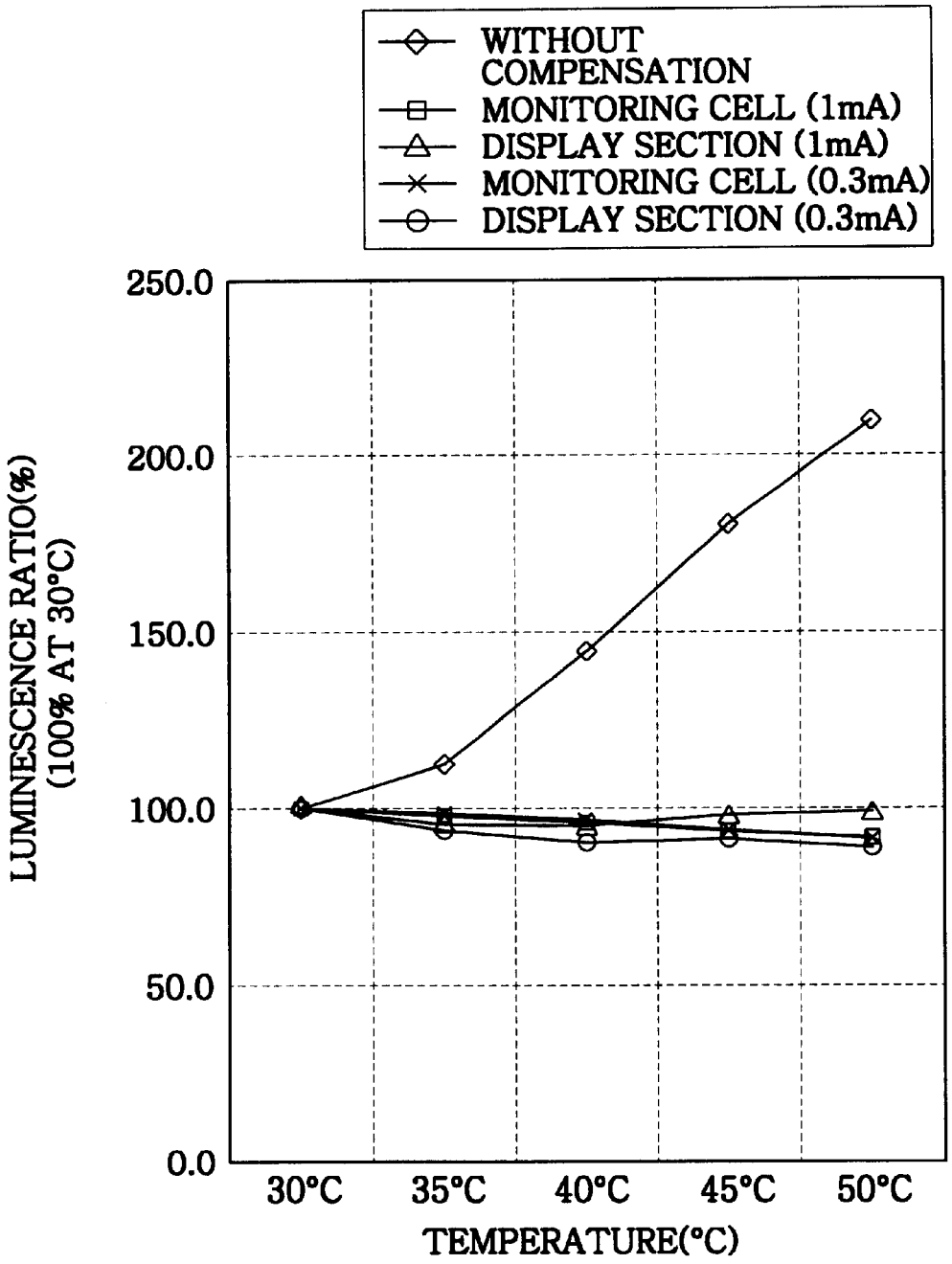
FIG. 3 sets forth a graph of measured luminescence values at various temperatures in cases with and without employing a temperature compensation circuit of the present invention in a constant voltage control in an organic EL display apparatus.

FIG. 3 and Table 1 set forth a graph and a table of measured luminescence values at various temperatures in cases with and without employing a temperature compensation circuit of the present invention in constant voltage control of an organic EL display apparatus.

TABLE 1

| Temp (° C.) | Without Compen-sation | Monitoring cell (1 mA) (%) | Display Section (1 mA) (%) | Monitoring cell (0.3 mA) (%) | Display Section (0.3 mA) (%) |
|---|---|---|---|---|---|
| 30 | 100.0 | 100.0 | 100.0 | 100.0 | 100.0 |
| 35 | 113.6 | 97.8 | 95.5 | 98.6 | 93.8 |
| 40 | 144.5 | 95.9 | 95.1 | 96.7 | 90.4 |
| 45 | 180.4 | 93.6 | 98.1 | 93.9 | 91.4 |
| 50 | 209.8 | 91.8 | 99.1 | 91.5 | 89.0 |

In other words, Table 1 and FIG. 3 set forth luminescence variation data when there is no temperature compensation circuit as well as when a driving current is controlled by a temperature compensation circuit. As can be seen in Table 1 and FIG. 3, when there is no temperature compensation, the luminescence level of a display section is increased to about 2.1 times by the temperature increase of 20° C.

However, both the display section and the monitoring cell of the organic EL display apparatus exhibit maximum variation of about 11% in the luminescence values for 20° C. temperature variation with 1 mA and 0.3 mA current flows under the control of the temperature compensation circuit of the present invention.

Figure 4:
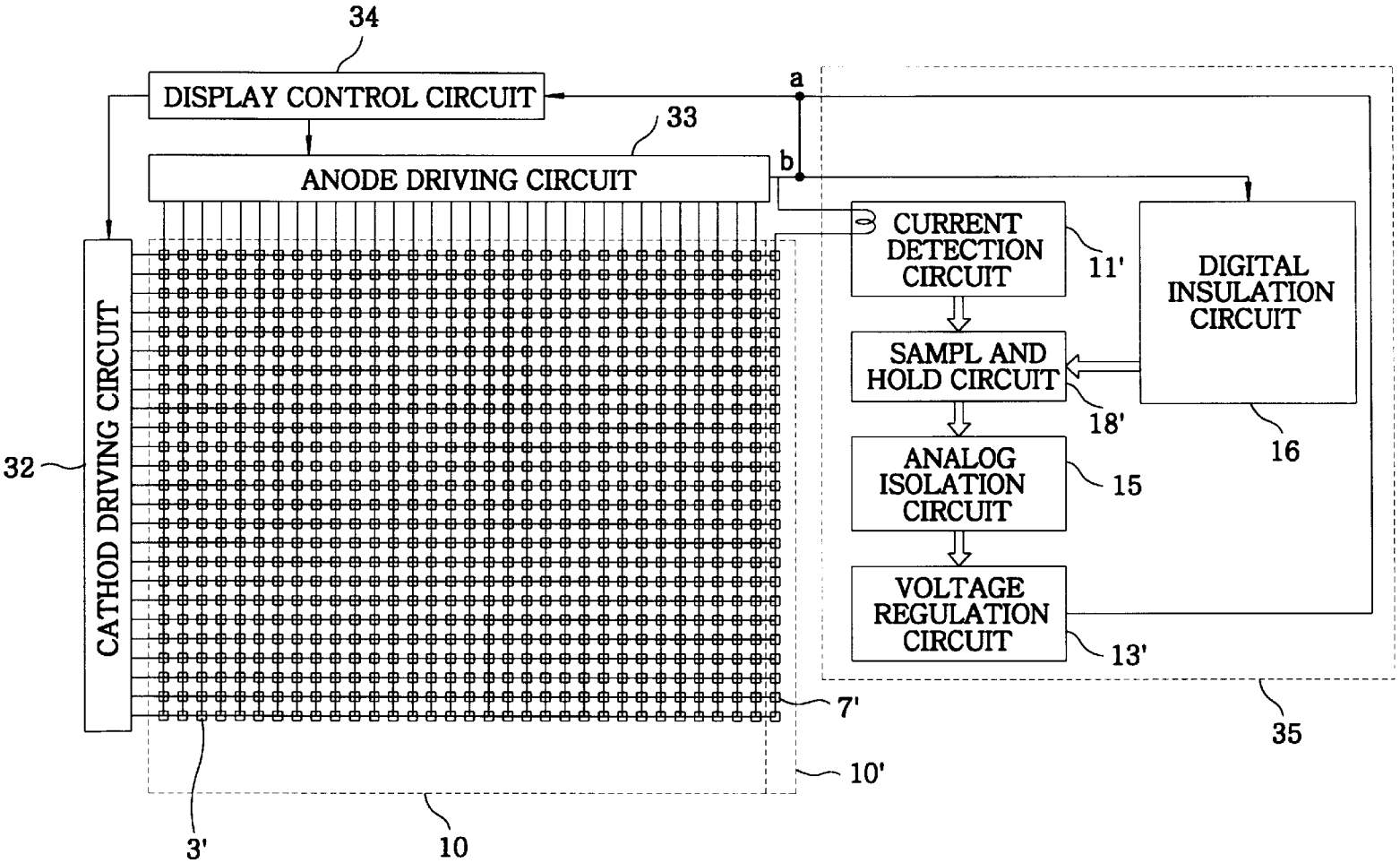
FIG. 4 illustrates a circuit diagram of an organic EL display apparatus for a case when light emitting units are arranged in a matrix form in accordance with a second preferred embodiment of the present invention.
Figure 5:
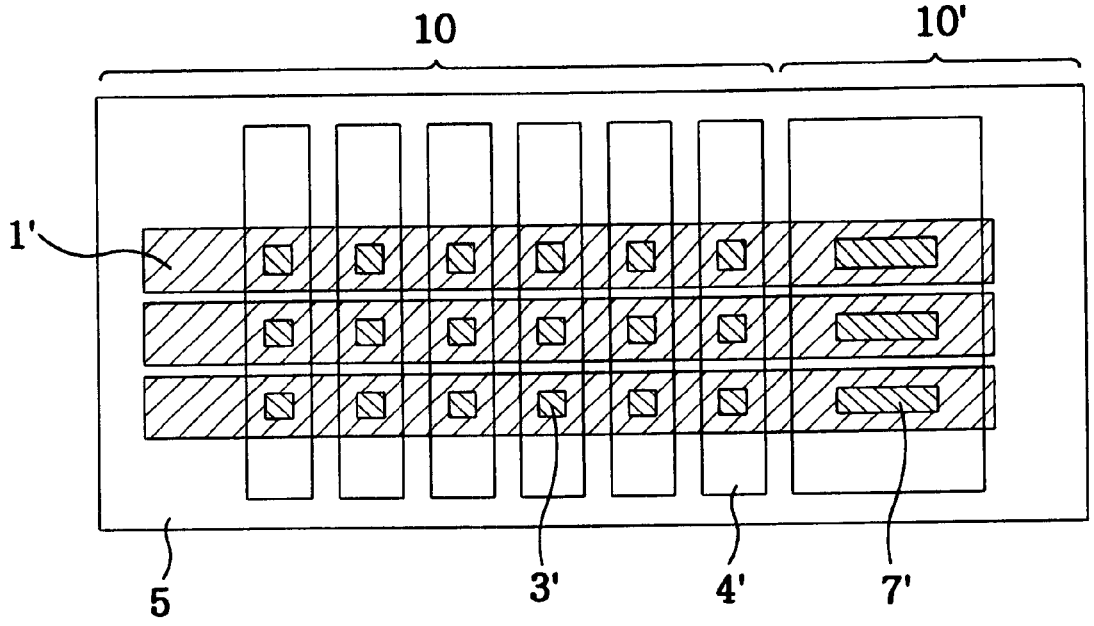
FIG. 5 gives an enlarged partial plan view of an organic EL display apparatus illustrating an arrangement of electrodes and light emitting elements in a display section and a monitoring section thereof in accordance with the second preferred embodiment of the present invention.

FIG. 4 illustrates a circuit diagram of an organic EL display apparatus 400 for a case when the light emitting units are arranged in a matrix form in accordance with a second preferred embodiment of the present invention. FIG. 5 gives an enlarged partial plan view of the organic EL display apparatus 400 shown in FIG. 4 illustrating an arrangement of electrodes and light emitting elements in a display section and a monitoring section thereof. In FIG. 5, reference numerals 1', 3', 4', 5 and 7' represent cathodes, light emitting cells, transparent anodes, a transparent glass and monitoring cells, respectively.

As illustrated in FIG. 4, the organic EL display apparatus 400 includes a display section 10 having therein the light emitting cells 3' arranged in the matrix form and a monitoring section 10' having therein the monitoring cells 7' arranged in one dimensional array. The organic EL display apparatus 400 also includes a display control circuit 34, an anode driving circuit 33, a cathode driving circuit 32 and a temperature compensation circuit 35. The temperature compensation circuit 35 includes a current detection circuit 11', a sample and hold circuit 18', a digital isolation circuit 16, an analog isolation circuit 15 and a voltage regulation circuit 13'.

The display control circuit 34 provides a display data signal and a scanning signal to the anode driving circuit 33 and the cathode driving circuit 32, respectively, thereby making the light emitting units 3' emit light to perform a matrix display. The temperature compensation circuit 35 has the same function as that of the temperature compensation circuit 220 shown in FIG. 2B and monitors a current in response to a scanning timing of the cathode driving circuit 32. The sample and hold circuit 18' supplies a sampled detection signal to the analog isolation circuit 15. The sample and hold circuit 18' and the analog isolation circuit 15 are electrically isolated by, e.g., a photocoupler. The voltage regulation circuit 13' supplies a voltage to the display control circuit 34. The digital isolation circuit 16 feeds a timing voltage to the sample and hold circuit 18'.

Driving voltages are continuously applied to a plurality of display elements, i.e., monitoring cells 7' in the monitoring section 10' regardless of display contents at the display section 10. The light emission at each of the monitoring cells 7' in the monitoring section 10' is sequentially performed at a timing identical to the scanning timing of the light emitting units 3'. A current flowing through the anode line of the monitoring section 10' is determined by the output of the voltage regulation circuit 13'. The monitoring current flows to the ground through a current detection resistor in the current detection circuit 11' and a cathode line selected by the cathode driving circuit 32. The resistance of the current detecton resistor is small enough not to effect the light emission from a monitoring cell and a detection voltage corresponding to the monitoring current is developed at the current detection resistor.

The detection voltage is amplified at the current detection circuit 11' and the amplified voltage signal is transmitted to the voltage regulation circuit 13' through the sample and hold circuit 18' and the analog isolation circuit 15. A light emitting current of the display apparatus 400 may be determined by a variable resistor (not shown) in the voltage regulation circuit 13'. The output of the voltage regulation circuit 13' is fed back to the display control circuit 34 to thereby adjust the supply voltage to the anode driving circuit 33 in order to maintain the light emitting current at the same level as the preset current.

Since strip shaped anodes 4' are made of transparent electrode material, e.g., ITO, there occurs a voltage drop in the anodes and, therefore, a higher driving voltage should be supplied to a light emitting cell located farther from the anode driving circuit 33 in order to compensate for the voltage drop in the anode. In accordance with the present invention, the driving voltage is automatically adjusted to compensate for the voltage drop by the feed back from the temperature compensation circuit 35 and the current level to each of the light emitting units 3' are adjusted to be substantially identical to the preset current level, enabling to obtain enhanced display quality.

There are blanking periods, i.e., vertical blanking periods during which none of the cathode lines are activated and therefore, none of the light emitting units 3' and the monitoring cells 7' are turned on in order to obtain a display quality (i.e., suppression of leaky luminescence). During the blanking periods, a current through the monitoring section 10' becomes temporally zero, and as a result, a driving voltage may be controlled to be a maximum value.

Such a problem, however, can be solved by performing voltage control based on a current value detected just before a blanking period without detecting the current during that blanking period by the sample and hold circuit 18' in response to a control signal from the display control circuit 34 representing the blanking periods.

While the output (a driving power source of the anode driving circuit 33) from the voltage regulation circuit 13' is shown to be directly applied to the detection resistor of the current detection circuit 11' in the preferred embodiment in FIG. 4 when a line "a-b" shown therein is connected, it is also possible to suppress the influence of the internal resistance of the anode driving circuit 33 by applying the voltage from the output terminal of the anode driving circuit 33 to the detection resistor when the line "a-b" is disconnected. It is also possible to stabilize the current detection performance by increasing the area of each of the monitoring cells 7' in the monitoring section 10'.

It is preferable that a density of a current passing through a monitoring cell is substantially identical to that for each light emitting unit on a same row of the monitoring cell. In other words, it is preferable that current densities for a monitoring cell and light emitting units sharing a same cathode line are substantially identical.

It is also preferable that wiring resistance of the organic EL device, i.e., the resistance of the cathode and anode lines, are made such that voltages applied to a monitoring cell and light emitting units sharing a same cathode line are substantially identical.

It is also preferable that an ON/OFF ratio of each monitoring cell is controlled such that the lifetime of the monitoring section becomes substantially equal to that of the display section.

While the invention has been shown and described with respect to the preferred embodiments, it will be understood by those skilled in the art that various changes and modifications may be made without departing from the spirit and scope of the invention as defined in the following claims.

What is claimed is:

1. An organic electroluminescence (EL) device comprising:

a display section having one or more light emitting units; and a monitoring section positioned outside the display section and having one or more monitoring cells, wherein each of the light emitting units and the monitoring cells includes a cathode, an anode and at least one organic EL layer positioned between the cathode and the anode, either cathodes or anodes of the light emitting units and the monitoring cells being transparent, and wherein a current passing through an anode and a cathode of a monitoring cell is monitored to control the light emitting units.

2. The organic EL device of claim 1, wherein the cathodes and the anodes of the light emitting units and the monitoring cells are arranged in a matrix form.

3. The organic EL device of claim 1, wherein an area of one monitoring cell is greater than that of each of the light emitting units.

4. The organic EL device of claim 1, wherein anodes and cathodes in the display section are separated from those in the monitoring section.

5. The organic EL device of claim 1, wherein a density of a current flowing through the monitoring section is substantially identical to that for the display section.

6. The organic EL device of claim 1, wherein substantially identical voltages are applied to the monitoring section and the display section, respectively.

7. The organic EL device of claim 1, wherein an ON/OFF ratio of the monitoring cells is controlled in order to make a lifetime of the monitoring section substantially equal to that of the display section.

8. The organic EL device of claim 1, further comprising a member for blocking light emitted from the monitoring section to thereby prevent the light from leaking out of the device.

9. A method for driving the organic EL display device of claim 1, further comprising the step of controlling a voltage applied to the display section by a feed-back of a voltage generated by a constant current flowing through the monitoring section.

* * * * *